United States Patent [19]

Golden

[11] 4,381,120

[45] * Apr. 26, 1983

[54] DESENSITIZATION SYSTEM FOR CARBONLESS COPY PAPER

[75] Inventor: Ronald Golden, Mt. Prospect, Ill.

[73] Assignee: Champion International Corporation, Stamford, Conn.

[ * ] Notice: The portion of the term of this patent subsequent to Apr. 22, 1997, has been disclaimed.

[21] Appl. No.: 256,509

[22] Filed: Apr. 22, 1981

Related U.S. Application Data

[63] Continuation of Ser. No. 810,384, Jun. 27, 1977, abandoned, which is a continuation of Ser. No. 627,060, Oct. 30, 1975, abandoned.

[51] Int. Cl.[3] ..... B41M 5/14; B41M 5/16; B41M 5/22

[52] U.S. Cl. ..... 282/27.5; 427/150; 427/151; 427/152; 427/261; 428/320.4; 428/320.6; 428/320.8; 428/537; 428/914

[58] Field of Search ..... 106/21; 282/27.5; 427/150–153, 261, 288; 428/307, 320.4, 320.6, 320.8, 411, 537, 913, 914

[56] References Cited

U.S. PATENT DOCUMENTS

| | | | |
|---|---|---|---|
| 3,809,668 | 5/1974 | Yarian | 282/27.5 |
| 4,021,059 | 5/1977 | Skelly et al. | 282/27.5 |
| 4,039,207 | 8/1977 | Ishizuka | 282/27.5 |
| 4,199,618 | 4/1980 | Golden | 427/145 |

*Primary Examiner*—Bruce H. Hess

*Attorney, Agent, or Firm*—Roylance, Abrams, Berdo & Farley

[57] ABSTRACT

Desensitization of carbonless copy systems is provided by contacting an electron-accepting, color-reactant material capable of reacting with a substantially colorless chromogenic compound to form a visible image with a desensitizing agent comprising, in combination, a non-volatile, polyoxygenated compound and a strong chelating agent. In this manner, acid-reactive clay coatings typically used in carbonless copy paper systems are effectively desensitized and prevented from reacting with conventional chromogens, such as crystal violet lactone and benzoyl leuco methylene blue.

14 Claims, No Drawings

DESENSITIZATION SYSTEM FOR CARBONLESS COPY PAPER

This application is a continuation of application Ser. No. 810,384, filed June 27, 1977, now abandoned which, in turn, is a continuation of application Ser. No. 627,060 filed on Oct. 30, 1975 now abandoned.

This invention relates to the desensitization of carbonless copy paper systems and to the desensitizing agents used therefor. More particularly, this invention relates to the desensitization of carbonless copy paper systems by the treatment of electron-accepting, color-reactant material with desensitizing agents for local desensitization.

Carbonless copy paper systems have found a widespread commercial acceptance, and the transfer copy form of such system has been particularly successful. One of the most widely utilized transfer copy systems involves the use of a coating of microscopic capsules containing a colorless dye intermediate material, such as crystal violet lactone, which is dispersed or dissolved in an oily solvent forming the nucleus or core of the microcapsules. The microcapsular coating is provided on the underside of a transfer sheet, and upon local application of a stylus to the upper side of the transfer sheet, the underlying capsules are ruptured and the chromogenic compound is released and transferred to an underlying copy sheet that is coated with an electron-accepting material, such as acid-acting clay, that will react with the chromogen causing a visible, colored mark at the points where the microcapsules have been ruptured and the dye transferred.

Transfer copy systems generally involve multi-part forms including a "CB" sheet, wherein the back or underside of the sheet is coated with the microcapsules containing chromogenic compounds, a "CFB" sheet which is a middle sheet having a coating on the upper side comprising an electron-accepting material of the Lewis acid type, and a coating of the image-forming microcapsules on its underside. The CB and CFB sheets are placed in register with a "CF" sheet, which has a coating of acid-acting clay or the like on its upper side. Thus, when the localized pressure is applied to the top side of the CB sheet, the microcapsules coated on the underside thereof are ruptured to release the chromogen, which reacts with the upper side of the CFB sheet to produce an image, while the very same localized pressure is transferred through the CFB sheet to the underside thereof in order to rupture the microcapsules thereunder and thus release the chromogenic material for reaction with the upper side of the CF sheet and produce an image thereon.

Multi-part forms involving such transfer copy systems have been conventionally employed in various applications, such as for invoices for billing purposes or the like, wherein it is desired to exclude data on certain copies while including such data on others. Thus, for example, a customer's copy of an order acknowledgment should not contain data which must be entered on copies to be used for internal purposes.

In order to provide multi-part forms, in which data can be included on one sheet, while excluded on another, the practice has been for the manufacturer of the carbonless copy paper system to provide the coated CF, CFB and CB paper webs to the printer, who then employs various desensitizing inks in order to block out certain selected areas of the form on one or more copies.

The desensitizing agents prevent the chromogen that is released from the CB and CFB coating from contacting a sensitized CF surface and thereby form an image. However, many of the conventional desensitizing agents have certain drawbacks. For example, one conventional desensitizing agents involves ammonium compounds as desensitizers. However, organic ammonium compounds are quite toxic and may provide a health hazard for the user.

Other desensitizing methods are based upon the use of lacquers which provide an impermeable barrier over the acid-reactive coating. However, this technique has the disadvantage that the lacquer compounds tend to become yellow upon aging.

Still another form of desensitizing agent that has been proposed is ethylenediaminetetraacetic acid (EDTA), as described in U.S. Pat. No. 3,809,668 to Yarian. However, the application of EDTA and its derivatives has generally been limited to specific types of copy systems, such as those employing dithiooxamide (DTO) or DTO derivatives as the dye precursor material. Although the suggestion has been made to use EDTA with the more conventional dye precursor materials, such as crystal violet lactone and benzoyl leuco methylene blue, coatings of EDTA on acid-acting clay does not provide complete desensitization at commercially desirable concentration levels.

It has now been found that desensitization of carbonless copy systems can be provided without the toxicity of prior systems, while achieving greater desensitization with conventional chromogenic compounds, such as crystal violet lactone and benzoyl leuco methylene blue, by employing the desensitization agents of the present invention, which comprise, in combination, a non-volatile, polyoxygenated compound and a strong chelating agent. Moreover, it has been found that the instant composition provides desensitization for a wide range of dyes.

Surprisingly, it has been discovered that the combination of strong chelating agents, such as EDTA, and its derivatives, in combination with non-volatile, polyoxygenated compounds, such as polyethylene glycols, provides desensitization in systems employing conventional chromogens, such as crystal violet lactone and benzoyl leuco methylene blue, which desensitization is not achievable utilizing either component, individually.

As will be hereinafter demonstrated, the use of EDTA, alone, at the concentration indicated therein cannot provide the required desensitization to prevent the formation of a perceptible image employing either CVL or BLMB in combination with an acidic clay. Likewise, the use of polyethylene glycol, alone, is ineffective to inhibit color formation in the presence of BLMB. On the other hand, the apparent synergistic combination of the EDTA and the polyoxygenated compound provides excellent desensitization and the formation of a perceptible image with CVL and BLMB is prevented.

As previously indicated, the desensitizing agent of the present invention comprises, in combination, a non-volatile, polyoxygenated compound and a complexing agent or strong chelating agent.

Suitable polyoxygenated compounds include those possessing either polyhydroxy groups or polyether groups. Such compounds include those compounds, therefore, in which the oxygen exists either as hydroxy functional groups or ether functional groups, including polyethylene glycol; polyethylene oxide; polyethylene oxide-polypropylene oxide copolymers; polypropylene oxide; glycols; polyglycols; glycol ethers; glycol esters; polyglycol ethers and esters; pentaerythritol, sorbital, and their derivatives; and compounds containing polyethylene oxide groups, in general, such as nonionic surfactants. Accordingly, the only requirement for the polyoxygenated compound is that it contain oxygen as ether or hydroxy functional groups, and that it not be volatile or fugative enough to be lost from the CF coating. Thus, the polyoxygenated compounds of the present invention must have a lower volatility than glycerin or ethylene glycol, for example.

Such polyoxygenated compounds, such as the polyethylene oxides and polyethylene glycols are commercially available from Union Carbide under the trade name "Polyox" and BASF Wyandotte under the trade name "Pluracol". Similarly, the polyethylene glycols, some of which are end capped by alkoxy groups containing from 1 to 5 carbon atoms, e.g., methoxy, ethoxy, propoxy, butoxy or pentoxy groups, are available from Union Carbide under the trade name "Carbowax", while polyethylene oxide-polypropylene oxide block copolymers are available under the trade names "Pluronic", "TETRONIC" and "Pluronic R", surfactants available from BASF Wyandotte. Still other surfactants, which may be nonionic, include ethoxylated nonylphenol, alcohol ethoxylates, and ethoxylated surfactants containing anionic groups. Likewise, humectants, such as sorbitol, pentaerythritol, and low molecular weight polyglycols, such as tetraethylene glycol, may be employed. Such polyoxygenated compounds, which may be employed in the present invention, are described throughout the literature, and include, for example, U.S. Pat. No. 2,674,619 to Lundsted, which describes polyoxyalkaline compounds of the type contemplated, and, and article by Stanton in "Soap and Chemical Specialties", 1957, Vol. 33, No. 6, pp. 47 et sequa.

The polyoxygenated compound is used in combination with a complexing agent, which is a strong chelating agent. The expression "strong chelating agent" as used herein means those complexing or sequestering agents having a stability constant with metals, such as iron, zinc or cobalt of greater than about 6. Although it is not intended to limit the present invention to any particular theory or mechanism, it is believed that metal ions participate in the development of color from benzoyl leuco methylene blue, for example, and it is therefore the complexing and isolating of metal ions which prevents the formation of color from BLMB.

Suitable complexing agents include ethylenediaminetetraacetic acid tetrasodium salt (EDTA-4Na), sodium citrate, the pentasodium salt of diethylenetriaminepentaacetic acid (DTPA-5Na), which is commercially available from Mona Industries Inc. under the trade name "Monaquest CAI-80", the trisodium salt of hydroxyethylenediaminetetraacetic acid (available as "Monaquest ICA-120"); the monosodium salt of dihydroxyethylglycine (available as "Monaquest CI"); nitrolotriacetic acid trisodium salt (commercially available from Dow Chemical as "Versene NTA") and the like. The preferred group of sequestering agents includes the EDTA and its derivatives as described in U.S. Pat. No. 3,809,668 and having the formula

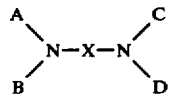

wherein

X is a divalent aliphatic or cycloaliphatic radical, preferably an alkylene radical of the formula $$-CH_2CH_2- \text{ or } -CH_2CH_2CH_2-$$

or a cyclic radical, such as cyclopentane, cyclohexane, etc., wherein the nitrogens are substituted 1,2- or 1,3-;

A, B, C, and D are selected from the following group of substituents:

hydrogen, an aliphatic or cycloaliphatic group, $$-CH_2-COOH$$

$$-CH_2-COOM$$

where M is an alkali metal ion, such as sodium, potassium or lithium, and $$-X'-\overset{\overset{E}{|}}{N}-F$$

where X' is similar to X, E and F are similar to A, B, C, and D; E or F can therefore be another —X—N(E)(F) unit, such that structures of the following type are formed:

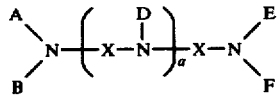

where a is 0, 1, 2, 3, 4 or other small integer. A, B, C, and D must comprise at least one $-CH_2-COOH$ or $-CH_2-COOM$ group.

The description and production of such compounds is defined in U.S. Pat. No. 3,809,668, as well as U.S. Pat. Nos. 2,901,335; 2,794,000; 2,428,353; and 3,234,173; the disclosure of EDTA and its derivatives as disclosed therein being incorporated herein by reference.

As previously indicated, the preferred sequestering agent is ethylenediaminetetraacetic acid tetrasodium salt.

In addition to the polyoxygenated and complexing compounds hereinabove discussed, an optional component in the form of triethanolamine may be employed.

Any suitable concentration of polyoxygenated compound and complexing agent may be employed. Suitable amounts include between about 10 and about 0.5 parts by weight of polyoxygenated compound per part by weight of complexing agent, preferably between about 3 and about 1 parts by weight of polyoxygenated compound per part by weight of complexing agent may be employed. The combination of polyoxygenated compound and complexing agent may be applied to the electron-acceptor sheet at a coat weight of between about 0.5 and about 4 pounds per ream, preferably between about 1 and about 2 pounds per ream. The term "ream" as employed herein is used to designated 3300 square feet.

The desensitizing agents of the present invention may be utilized in an aqueous or non-aqueous coating solution, which is applied to acid-reactive receptor coatings, i.e., CF coatings of carbonless copy paper composites in order to render the CF coating inactive with respect to chromogenic compounds released under pressure from the corresponding CB sheet. In addition to the desensitizing agents, the desensitizing formulation may include any additives which are compatible with the desensitizing agents and which are typically used in printing ink formulations. Such additives may include pigments, dyes, viscosity modifiers, solvents, resins and the like. By reducing the content of the ionic components of the desensitizing composition, a non-aqueous solvent may be used, if desired. This permits the use of certain classes of compounds which are not water-soluble, but are active in the desensitization of CF coatings.

The resulting desensitizing solutions may be applied using typical printing techniques in order to "spot" desensitize specific areas of a CF receptor sheet in a carbonless copy paper manifold. The application of the desensitizing agents of the present invention will provide non-reactive areas which will not form an image under pressure for use in multi-part forms, such as airline tickets, invoices and the like, in which certain parts of the form do not require all of the information shown on another part.

The electron-acceptor materials which may be desensitized employing the desensitizing agents of the present invention include any electron-accepting agent including the well-known acidic materials conventionally employed in CF coatings including bentonite, kaolin, acidic clay, talc, aluminum silicate, calcium citrate, metal oxides, metal chlorides, or the like. Additionally, the chemical desensitizers of the present invention may be used with CF coatings containing the various phenolic compounds and carboxylic acid metal salts. However, the present desensitizers are preferably utilized with acid-reactive clay coatings and coatings containing metal salts of carboxylic acids.

As previously indicated, the desensitizer compositions of the present invention are particularly effective with the conventional colorless chromogenic compounds, such as crystal violet lactone and benzoyl leuco methylene blue. However, it should be understood that the desensitizers of the present invention may be utilized to desensitize any electron-accepting material in a CF coating, and any of the colorless or substantially colorless chromogenic compounds that are utilized in carbonless copy paper systems, including any of the conventional leuco dyes and derivatives of bis(p-dialkylaminoaryl)methane, such as disclosed in U.S. Pat. Nos. 2,981,733 and 2,981,738, and the chromogens described in U.S. Pat. Nos. 3,819,396; 3,821,010; 3,875,074; and the like.

Thus, suitable chromogenic compounds include the leuco dyes which are capable of reversably forming a colored, carbonium ion species such as those having the general formula

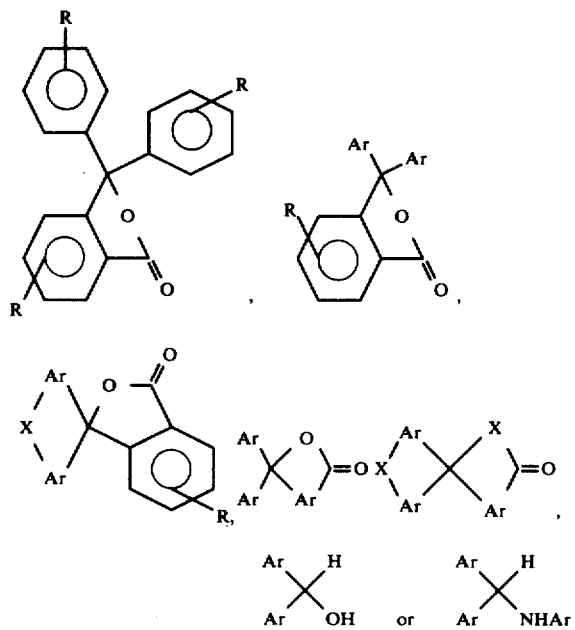

wherein Ar is an aromatic nucleus capable of supporting a positive charge; R is a group capable of stabilizing a positive charge, and X is a heteroatom such as oxygen or nitrogen.

Specific examples of suitable leuco dyes include: leuco triarylmethane dyes such as 3,3-bis(p-dimethylaminophenyl)-6-dimethylaminophthalide (crystal violet lactone), 3,3-bis(p-dimethylaminophenyl) phthalide (malachite green lactone), 3-(p-dimethylaminophenyl)-3-(1,2-dimethylindol-3-yl) phthalide, 3-(p-dimethylaminophenyl)-3-(2-phenylindol-3-yl) phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3-p-dimethylaminophenyl-3-(1-methylpyrrol-2-yl)-6-dimethylaminophthalide, 7-(1-ethyl-2-methylindol-3-yl)-7-(3-ethoxydiethylaminophen-4-yl)-5, 7-dihydrofuro [3,4-b]pyrazin-5-one, 3-(p-dimethylaminophenyl)-3-(1-methylpyrrol-2-yl)-4,5,6,7-tetrachlorophthalide, 7-(1-ethyl-2-methylindol-3-yl)-7-(3-methyldimethylaminophen-4-yl)-5, 7-dihydrofuro [3,4-b]pyridin-7-one, 3-(4-diethylaminophenyl)-3-(1, 2-diethylindol-3-yl) napthalide; diphenylmethane compounds such as leuco auramine, N-halophenyl lueco auramine, 4,4'-bis-dimethylaminobenzhydrine benzyl ether; xanthene compounds such as rhodamine B lactam, rhodamine B-(p-chloroanilino)lactam, 7-dimethylamino-2-methoxyfluoran, 2,2'-iminobis (6-dimethylaminofluoran), 3-diethylamino-7-(N'-paramethoxyphenyl) piperazinofluoran, 2'-[N-(carbethoxymethyl)amino]-6'-diethylaminofluoran, 6'-diethylamino-2'-[N-(N,N'-dimethylcarbamoyl) methylamino] fluoran, 6'-diethylamino-2'-(p-nitrobenzenesulfonamino) fluoran; spiropyran and benzopyran compounds such as 3,3'-dichlorospiro-dinapthopyran, 3-benzyl-spiro-dinapthopyran, 3-propyl-spiro-dibenzopyran, 2-(2,5-dichloroanilino)-2-(p-methoxyphenyl)-2(H) benzopyran, 5-dimethylaminospiro-[isofuran-1(3H)-2' (2H)-1-benzopyran-3-one]; acridan dyes such as 9-(p-dimethylaminophthalyl-3)-10-methylacridan and the like.

The foregoing chromogenic compounds are only given for purposes of illustration since any chromogenic compound which is capable of reacting with an electron-acceptor material may be employed.

The chromogenic compounds are isolated from the desensitized CF coating by microencapsulation, as previously indicated, and such microcapsules may be provided in any conventional manner, such as by the microencapsulation systems described, for example, in U.S. Pat. Nos. 3,418,656 and 3,418,250 to A. E. Vassiliades, or U.S. Pat. No. 3,875,074 to Vassiliades et al, which are hereby incorporated by reference.

The following examples illustrate the effectiveness of the desensitizing agents of the present invention. The percentages are by weight unless otherwise indicated.

EXAMPLE I

Fifteen grams of ethylenediaminetetraacetic acid tetrasodium salt (EDTA) are dissolved in 85 grams of water and are coated on a CF receptor sheet having a coating of acidic clay. A coat weight of about 2 pounds per ream (3300 square feet) is employed.

Meanwhile, a CB coated sheet of the type described in the working examples of U.S. Pat. No. 3,875,074 containing only encapsulated crystal violet lactone is placed above the CF sheet and pressure is applied over both untreated and treated areas of the CF sheet to produce an image. A strong blue image appears in the untreated area, while a weak, but still perceptible image appears in the area treated by EDTA, alone.

The results of Example I indicate that EDTA is ineffective at the concentration employed to completely desensitize the CF receptor sheet at the areas applied.

EXAMPLE II

A CF receptor sheet of the type utilized in Example I is treated with a 5 percent by weight solution of polyethylene glycol (commercially available as "Carbowax 350" from Union Carbide) at a coat weight of about 1 pound per ream. A CB sheet of the type employed in Example I containing only encapsulated crystal violet lactone chromogen is placed over the CF sheet and pressure is applied over both the untreated and treated areas of the CF layer to form a strong blue image in the untreated area. No color develops in the treated area. The CF sheet is exposed to air and fluorescent light for a week with no indication of image development in the treated area.

The results of Example II indicate that the polyethylene glycol desensitizer is effective as a desensitizing agent in conjunction with CVL alone.

EXAMPLE III

A CF receptor sheet is treated with a 5 percent solution of triethanolamine at a coat weight of about 1 pound per ream. The CB sheet containing encapsulated CVL is placed over the CF sheet and pressure is applied over both the treated and untreated areas of the CF layer to form a strong blue image in the untreated area. A barely perceptible image appears; however, it is significantly weaker than that observed with the EDTA treatment.

The results of this example indicate that triethanolamine is ineffective, alone, as a desensitizer for CVL.

EXAMPLE IV

The procedures of Examples I through III are repeated using a CB sheet containing only encapsulated benzoyl leuco methylene blue (BLMB). As BLMB developes color very slowly, no strong image appears, initially, employing either the EDTA, the polyethylene glycol or the triethanolamine. However, after several hours a strong blue-green image appears in all of the untreated areas, while an attenuated, but still clearly visible image appears in the treated areas including those areas treated with EDTA.

This example indicates that neither EDTA, PEG nor triethanolamine, alone, are effective as desensitizers for BLMB.

EXAMPLE V

A solution containing 10 grams of EDTA tetrasodium salt, 10 grams of polyethylene glycol and 80 grams of water is coated on a CF receptor sheet of the type described in Example I at a coat weight of about 2 pounds per ream.

Next, a combination of 2.1 parts CVL and 1.8 parts BLMB are applied to the treated and untreated areas of the CF sheet using pressure on a superimposed CB sheet containing the CVL and BLMB in microcapsules. A strong CVL image immediately appears on the untreated image, while a BLMB image appears after a longer development time. However, no image developes from either the CVL or the BLMB in the treated areas, even after exposure to air and fluorescent light for a week.

This example demonstrates the synergistic combination resulting from the use of EDTA tetrasodium salt in combination with polyethylene glycol, since the combination was able to desensitize the acidic clay with respect to both CVL, and BLMB, whereas neither desensitizing component, alone, was capable of doing so.

Although the invention has been described in considerable detail with particular reference to certain preferred embodiments thereof, variations and modifications can be effected within the spirit and scope of the invention as described hereinbefore, and as defined in the appended claims.

What is claimed is:

1. A manifold record system comprising a first substrate and a second substrate, said first substrate having a CB coating comprising an encapsulated substantially colorless, chromogenic material, said second substrate having a CF coating comprising an electron-accepting material, said first substrate being superposed over said second substrate with said CB coating adjacent said CF coating, said CF coating being partially desensitized over local areas thereof with a desensitizing agent comprising, in combination, two separate components, the first component being polyethylene glycol end capped by alkoxy groups containing from 1 to 5 carbon atoms, and the second component having the formula

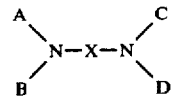

wherein X is an alkylene radical of the formula $—CH_2CH_2—$ or $—CH_2CH_2CH_2—$, and A, B, C, and D are selected from the group consisting of:

hydrogen,
an aliphatic group,
a cycloaliphatic group,
$—CH_2COOH$, and

—$CH_2COOM$ where M is the alkali metal ion, sodium, potassium or lithium, in amounts between about 10 and about 0.5 parts by weight of said first component per part by weight of said second component.

2. The record system of claim 1 wherein said substantially colorless chromogenic material is crystal violet lactone.

3. The record system of claim 1 wherein said substantially colorless chromogenic material is benzoyl leuco methylene blue.

4. The record system of claim 1 wherein said substantially colorless chromogenic material comprises a combination of crystal violet lactone and benzoyl leuco methylene blue.

5. The record system of claim 4 wherein said first component is polyethylene glycol end capped with methoxy groups.

6. The record system of claim 5 wherein said second component is ethylenediaminetetraacetic acid tetrasodium salt.

7. The record system of claim 6 wherein said desensitizing agent additionally comprises triethanolamine.

8. The method of claim 1 wherein said first component and said second component are used in amounts of between about 3 and about 1 part by weight of said first component per part by weight of said second component.

9. A method for desensitizing portions of record material, said record material comprising a coating containing an electron-accepting, color-reactant material capable of reacting with a substantially colorless, chromogenic compound to form a visible image, said method comprising applying a desensitizing agent to selected areas of said coating of said electron-accepting material, said desensitizing agent comprising, in combination, two separate components, the first component being polyethylene glycol end capped by alkoxy groups containing from 1 to 5 carbon atoms, and the second component having the formula

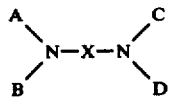

wherein X is an alkylene radical of the formula —$CH_2CH_2$— or —$CH_2CH_2CH_2$—, and A, B, C, and D are selected from the group consisting of:

hydrogen, an aliphatic group, a cycloaliphatic group,

—$CH_2COOH$, and

—$CH_2COOM$ where M is the alkali metal ion, sodium, potassium or lithium, in amounts between about 10 and about 0.5 parts by weight of said first component per part by weight of said second component.

10. The method of claim 9 wherein said first component is polyethylene glycol end capped with methoxy groups.

11. The method of claim 10 wherein said second component is ethylenediaminetetraacetic acid tetrasodium salt.

12. The method of claim 11 wherein said first component and said second component are used in amounts of between about 3 and about 1 part by weight of said first component per part by weight of said second component.

13. The method of claim 11 wherein said desensitizing agent additionally comprises triethanolamine.

14. The method of claim 9 wherein said second component is ethylenediaminetetraacetic acid tetrasodium salt.

* * * * *